US006481597B1

(12) United States Patent
Cermak, III

(10) Patent No.: US 6,481,597 B1
(45) Date of Patent: Nov. 19, 2002

(54) PLUG ASSEMBLY FOR REMOVABLE RESEALING OF CAULKING TUBE NOZZLE AND METHOD OF USE

(76) Inventor: William F. Cermak, III, 405 Hunters Way, Fox River Grove, IL (US) 60021

( * ) Notice: Subject to any disclaimer, the term of this patent is extended or adjusted under 35 U.S.C. 154(b) by 0 days.

(21) Appl. No.: 10/074,647

(22) Filed: Feb. 13, 2002

(51) Int. Cl.[7] ..... B67D 5/00
(52) U.S. Cl. ..... 222/83; 215/355; 222/563
(58) Field of Search ..... 222/151, 563, 222/83, 541.5; 215/360, 358, 355

(56) References Cited

U.S. PATENT DOCUMENTS 953,123 A * 3/1910 Conradson ..... 215/355
4,957,225 A 9/1990 Childers
5,154,327 A 10/1992 Long
5,248,071 A 9/1993 Ray
5,295,601 A 3/1994 Bostelman
6,223,957 B1 5/2001 Hoppe
6,375,051 B1 * 4/2002 Iverson ..... 222/563

* cited by examiner

*Primary Examiner*—Philippe Derakshani
(74) *Attorney, Agent, or Firm*—Edward Gray

(57) ABSTRACT

A plug assembly for removably resealing a caulking tube nozzle includes a plug with a handle-like upper portion and a conically tapering lower portion with contiguous scoring edges each having a leading and a trailing surface which form a sharp circumferential point. By firmly inserting the plug into the nozzle aperture and then screwing it in, one or several points score the nozzle interior surface to form grooves. Meshing of points and grooves in combination with residual caulking material in the nozzle create an air-tight seal. The nozzle, reopened by unscrewing the plug, can be repetitively resealed because the scoring edges track within the preformed grooves. The assembly further includes a piercing shaft, breakably separable from the plug, for puncturing a foil seal on the tube front end.

10 Claims, 4 Drawing Sheets

PLUG ASSEMBLY FOR REMOVABLE RESEALING OF CAULKING TUBE NOZZLE AND METHOD OF USE

BACKGROUND OF THE INVENTION

1. Field of the Invention

This invention relates to closures for sealing nozzles, and more particularly to a plug for removably resealing the distally tapering nozzle of a container having extrudable air-curable material such as caulking and adhesive, to prevent leakage and hardening 2. Description of the Related Art Sealant and gluing materials such as caulking and construction adhesives and other air-curable materials are commonly sold in rigid paper or plastic cylindrical tube, cartridge-type containers from which the material is extrudable. Such tubes typically include a conically tapering dispensing nozzle with a distally tapering bore therethrough, made of a soft plastic and attached proximally to a tube end and terminating distally in a sealed tip so that the material is isolated from air until ready for use. The relatively wide proximal end of the nozzle is often superposed over a foil or film seal covering a circular aperture in the tube end, so that after the nozzle tip is severed a thin rigid tool must be inserted through the nozzle to pierce the seal. Depending on the particular application, the user is advised by the manufacturer to precisely cut the tip so that the opening formed will extrude a bead of appropriate size. Typically, the diameter of this dispensing aperture is between ⅛-inch and 5/16-inch, but may be larger. The tube is then inserted into a gun or similar device which applies pressure to a piston-like plunger in the rear of the tube so as to force material through the nozzle and out the tip opening. If sufficient material has been extruded to complete the job at hand but the tube contents are not exhausted, the user is faced with the problem of closing the opening so that air cannot leak in. Otherwise residual material in the nozzle as well as unextruded material in the tube will harden due to exposure to air, precluding future reuse. A common practice is to insert a nail or screw into the opening but because the opening size is non-standard and the choice of nails and screws at hand is likely to be limited, an ad hoc fit sufficiently tight to create an airtight seal is unlikely. If the material inside the nozzle does become hardened and is mainly near the tip, another practice is to cut away enough of the nozzle so that the hardened material is substantially removed, and then use a piercing tool to open a conduit to unhardened material within the tube. However, shortening the nozzle changes the size of the opening so that the size of the extruded bead is undesirably increased.

Plugs for resealing a nozzle attached to a container of air-curable extrudable material are known in the art. U.S. Pat. No. 6,223,957 to R. G. Hoppe discloses a conically tapering plug which is inserted into the nozzle through the tip opening until a tight fit is obtained. In a preferred embodiment the plug outer wall is generally smooth. In three alternate embodiments the outer wall includes discontinuities, specifically threads, steps, or ridges. Use of discontinuities allows a user to apply frictional force by twisting the plug as it is inserted, providing an "insertion interference fit" and thus a greater sealing effect. The plug may be attached to a housing to which is also attached a spike for puncturing the tube end seal.

U.S. Pat. No. 5,248,071 to C. D. Ray discloses a nozzle and cap assembly for resealing a tube of caulking material, sealant, adhesive or the like. The assembly, intended to replace a standard dispensing nozzle, includes a nozzle having exterior threaded sections of varying diameter located along its length, and a cylindrical cap sealed at one end and having interior threaded sections of varying diameter along its length for engaging the exterior threads on the nozzle, thus forming an air-tight seal when the cap is screwed onto the nozzle.

U.S. Pat. No. 5,295,601 to R. F. Bostelman discloses a cap for resealing a caulking tube cartridge to prevent premature drying out of the material stored within the cartridge and also to prevent blockage within the nozzle. The cap includes a plug member having a tubular threaded metal insert and two integral wings, and a tapered orifice retainment rod. In an alternate embodiment the plug member also has integral interior threads. The rod is inserted into the nozzle until the nozzle tip is engaged within the tubular insert. Using the wings the plug member is then rotated until the metal insert threads or the integral threads engage the outside surface of the nozzle.

U.S. Pat. No. 5,154,327 to K. D. Long discloses a sealable nozzle adaptor for use with a caulking tube cartridge which slides over the tube end. The adaptor includes a nozzle portion closely fitted over the dispensing nozzle, a base including a flexible skirt portion for engaging the tube end, a cap for closing and sealing the tip opening of the dispensing nozzle, and an elongated pin secured in the cap and extending into the nozzle portion.

U.S. Pat. No. 4,669,635 to D. E. Brookhart discloses a tool for clearing and sealing a dispensing nozzle. The tool includes a shaft with a plurality of barbs projecting from its surface, spaced around the circumference and along the length of the shaft. The tool is used to seal the nozzle tip by inserting the shaft so that at least some of the barbs are surrounded by flowable caulking in the tip. This caulking eventually hardens, surrounding and tightly engaging the shaft and barbs. The hardened material is removed from the tip by grasping the tool handle and pulling outwardly.

None of these references discloses a closure which provides air-tight repetitive resealing of a standard dispensing nozzle yet is inexpensive and therefore disposable, so that the permanently soiled closure may be discarded along with the depleted tube.

OBJECTS OF THE INVENTION

In view of the limitations of the related art, it is an object of the present invention to provide a plug capable of removably resealing the opening of a standard dispensing nozzle regardless of the opening's size and contour.

Another object of the invention is to provide a plug assembly including a piercing shaft that can be fabricated as a unitary molding.

A further object of the invention is to provide an assembly wherein the piercing shaft is easily separated from the plug.

Yet another object of the invention is to provide a plug that is simple to use and inexpensive to buy, even in quantity.

Other objects of the invention will become evident when the following description is considered with the accompanying drawing figures. In the figures and description, numerals indicate the various features of the invention, like numerals referring to like features throughout both the drawings and description.

SUMMARY OF THE INVENTION

These and other objects are achieved by the present invention which in one aspect provides a plug assembly for removably resealing an aperture in a dispensing nozzle attached to a container of extrudable material. The nozzle is made of a deformable soft plastic and has an axially symmetric bore determined by a distally tapering interior surface. The plug assembly includes a plug including an upper portion attached to a conically tapering lower portion which has a multiplicity of successively contiguous circumferential scoring edges terminating in a leading scoring edge determining a distal end having a preselected circumference. Each distally successive scoring edge is slightly smaller in circumference, and each scoring edge is canted rearwardly at a first angle to a common longitudinal axis. Each scoring edge has a leading edge surface making a second angle with respect to an axis orthogonal to the longitudinal axis and a trailing edge surface making a third angle with respect to the orthogonal axis. The leading and trailing edge surfaces form a sharp point. The circumference of the distal end of the plug lower portion is sized to enable penetration of the aperture by at least the leading scoring edge, thereby contacting and scoring at least one groove in an annular segment of the nozzle interior surface.

The plug assembly further includes a cylindrical piercing shaft having a first end attached to the plug distal end, and an opposed end terminating in a blunt tip. The first end is proximate to a groove circumscribing the shaft. The plug and shaft are breakably separable at the groove.

In another aspect the invention provides a plug assembly for removably resealing an aperture of a preselected circumference in a dispensing nozzle attached to a container of extrudable material. The nozzle is made of a deformable soft plastic and has an axially symmetric bore determined by a distally tapering interior surface. The plug assembly includes a plug including an upper portion having a planar top surface orthogonal to a plurality of convexly arcuate knurls, with each pair of neighboring knurls separated by a concavely arcuate depression. The plug further includes a circumferential skirt, having a polygonal plurality of planar edge segments, attached to the plug upper portion. The plug further includes a conically tapering lower portion, attached to the skirt, having a multiplicity of successively contiguous circumferential scoring edges terminating in a leading scoring edge determining a distal end. Each distally successive scoring edge is slightly smaller in circumference. Each scoring edge is canted rearwardly at a first angle to a common longitudinal axis. Each scoring edge has a leading edge surface making a second angle with respect to an axis orthogonal to the longitudinal axis and a trailing edge surface making a third angle with respect to the orthogonal axis. The leading and trailing edge surfaces form a sharp point. The circumference of the distal end of the plug lower portion is sized to enable penetration of the aperture by at least the leading scoring edge, thereby contacting and scoring at least one groove in an annular segment of the nozzle interior surface.

In yet another aspect the invention provides a method for removably resealing an aperture in a dispensing nozzle attached to a container of an extrudable material. The distally tapering nozzle is made of a deformable soft plastic and has an axially symmetric bore determined by a distally tapering interior surface. The method includes the step of fabricating a plug including an upper portion attached to a conically tapering lower portion which has a multiplicity of successively contiguous circumferential scoring edges terminating in a leading scoring edge determining a distal end. Each distally successive scoring edge is slightly smaller in circumference. Each scoring edge is canted rearwardly at a first angle to a common longitudinal axis. Each scoring edge has a leading edge surface making a second angle with respect to an axis orthogonal to the longitudinal axis and a trailing edge surface making a third angle with respect to the orthogonal axis. The leading and trailing edge surfaces form a sharp point. The circumference of the distal end of the plug lower portion is sized to enable penetration of the aperture by at least the leading scoring edge. The method further includes the step of penetrating the aperture with at least the leading scoring edge, thereby contacting and scoring at least one groove in an annular segment of the nozzle interior surface. The method further includes the step of screwing in the plug so as to penetrate further into the nozzle bore and create additional grooves in the surface segment as the points of additional scoring edges contact the surface segment.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENT

Figures 1, 1A:
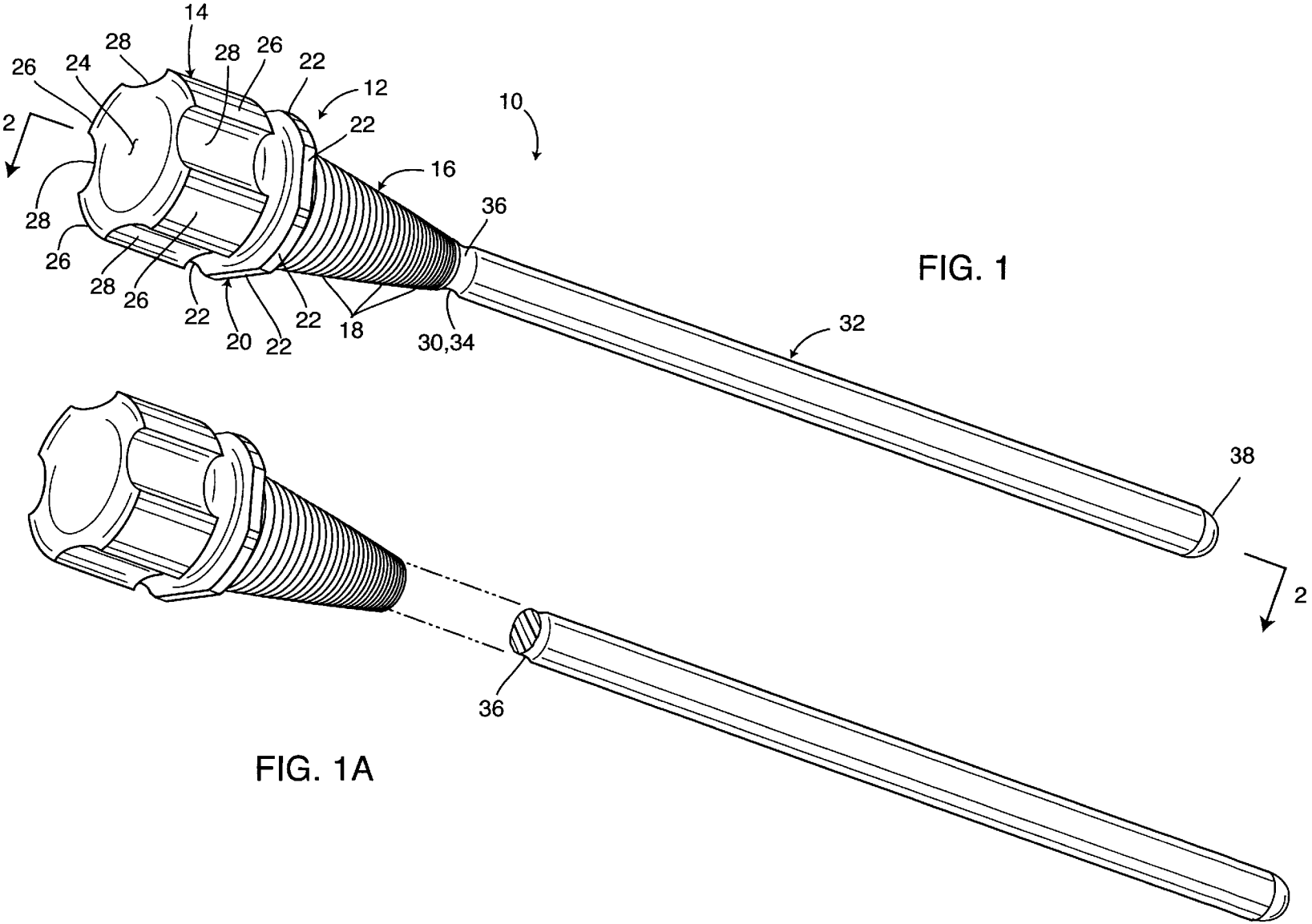
FIG. 1 is a perspective view of a plug assembly according to the invention, including a plug with a knurled upper portion and a conically tapering lower portion with a multiplicity of contiguous circumferential scoring edges, and a piercing shaft breakably attached to the plug lower portion.
FIG. 1A is a perspective view of the FIG. 1 plug separated from the piercing shaft.

While the present invention is open to various modifications and alternative constructions, the preferred embodiment shown in the drawings will be described herein in detail. It is to be understood, however, there is no intention to limit the invention to the particular form disclosed. On the contrary, it is intended that the invention cover all modifications, equivalences and alternative constructions falling within the spirit and scope of the invention as expressed in the appended claims.

Where used herein, the word "attached" means that the two parts referred to are either fabricated in a single piece, preferably by molding of a thermoplastic, or bonded, glued or otherwise permanently joined together.

Referring to FIG. 1, a plug assembly 10 according to the invention includes a plug 12 with a knurled upper portion 14, and a conically tapering lower portion 16 with a multiplicity of successively contiguous circumferential scoring edges 18. Disposed between and rigidly attached to upper and lower portions 14, 16 is a circumferential skirt 20 having a polygonal plurality of generally planar edge segments 22 which prevent the plug from rolling when placed horizontal on a flat surface. Upper portion 14 has a generally planar top surface 24 generally orthogonal to a plurality of convexly arcuate knurls 26, with each pair of neighboring knurls separated by a concavely arcuate depression 28. Flat surface 24 allows the plug to be placed vertically on a flat surface without tipping over. Upper portion 14 is of greater mass than lower portion 16 to keep the plug lying horizontal on a flat surface, even with residual caulking material caked on the scoring edges. In the preferred embodiment, a circle circumscribing the knurls of upper portion 14 is about ⅜-inch in diameter. Plug lower portion 16 terminates in an end 30 to which is rigidly attached a rigid, generally cylindrical piercing shaft 32 at an end 34 proximate to a groove 36 circumscribing the shaft. Opposed end 38 of shaft 32 terminates in a blunt tip. A blunt tip is preferable to a sharp tip to reduce the hazard of accidental injury to the user. The shaft is of sufficient length to reach the foil seal on all standard size tubes of caulking and adhesives. Referring to FIG. 1A, groove 36 provides a visual reference for separating the plug and shaft. Separation is easily effected by bending the shaft while firmly gripping the plug lower portion. In an alternate embodiment the plug is fabricated without an attached shaft.

Figure 2:
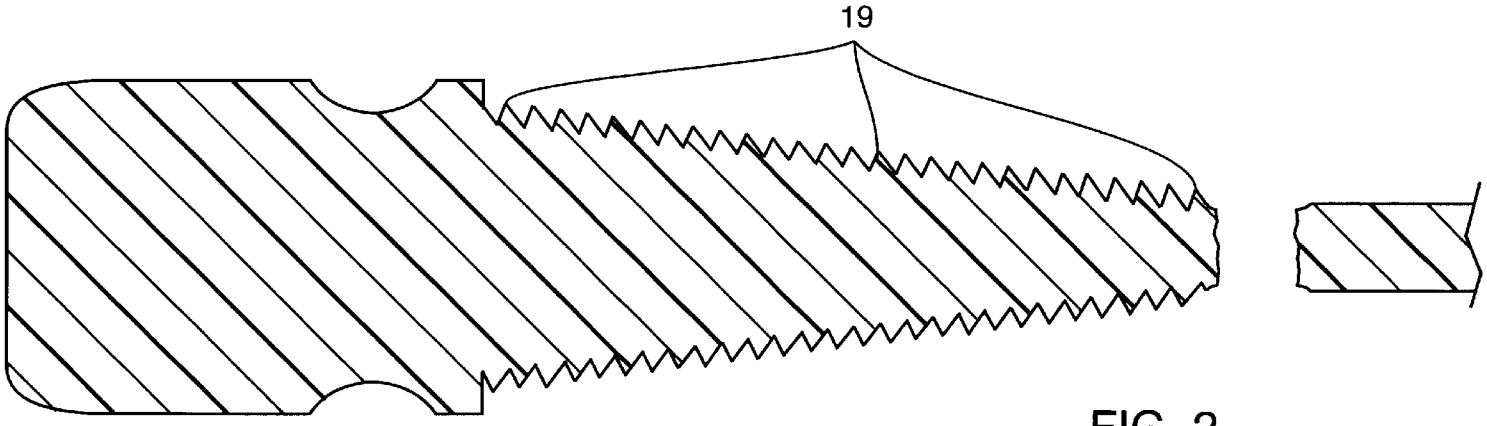
FIG. 2 is a sectional view taken along line 2—2 in FIG. 1.
Figure 3:
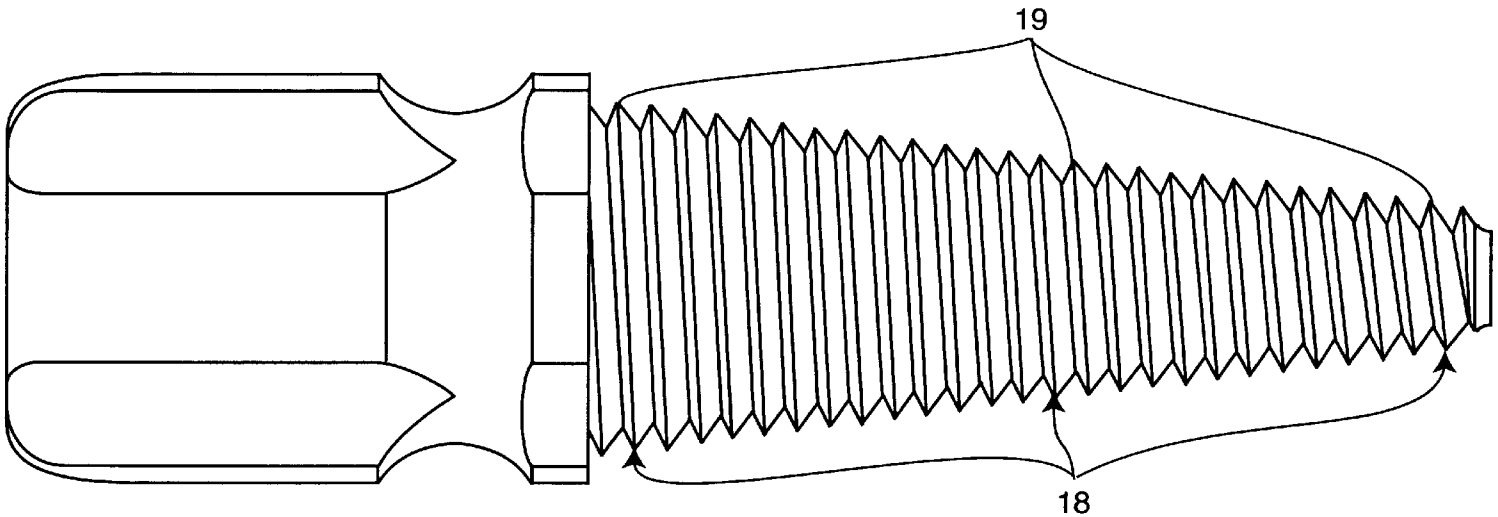
FIG. 3 is an elevational view of the FIG. 1A plug showing the configuration of the scoring edges.
Figure 3A:
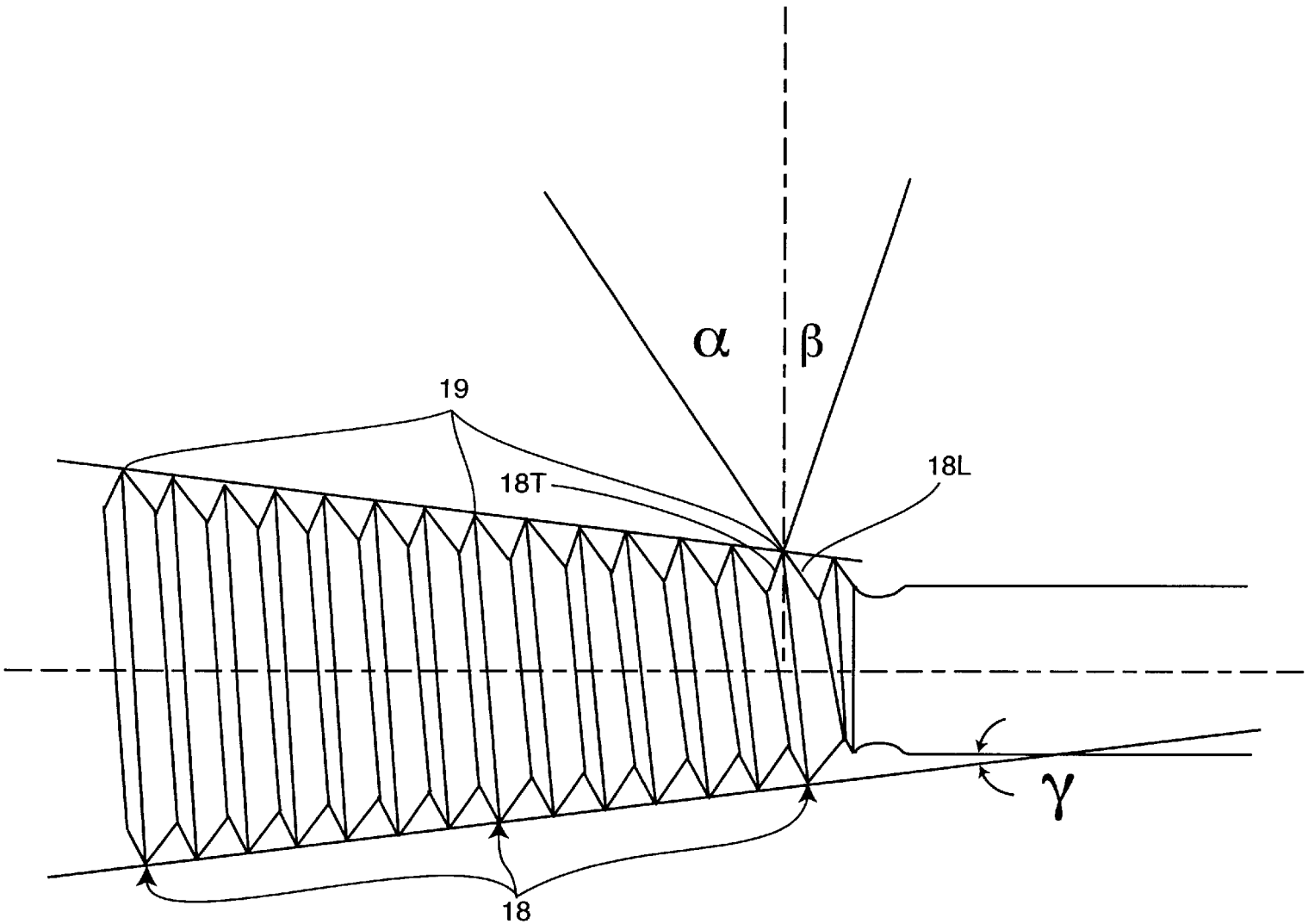
FIG. 3A shows the angular configuration common to each of the FIG. 3 scoring edges.

Referring to FIGS. 2, 3 and 3A, each scoring edge 18 is canted rearwardly at an acute angle $\gamma$ to a common longitudinal axis, and has a leading edge surface 18L making an acute angle $\alpha$ with respect to an axis orthogonal to the longitudinal axis, and a trailing edge surface 18T making an acute angle $\beta$ with respect to the orthogonal axis. Preferably, angle $\alpha$ is in a range between about 30 degrees to about 40 degrees, angle $\beta$ is in a range between about 15 degrees to about 25 degrees, and angle $\gamma$ is in a range from about 5 degrees to about 12 degrees. Surfaces 18L and 18T come to a sharp point 19, forming a "knife edge." Each distally successive scoring edge is slightly smaller in circumference so that the envelope encompassing the totality of scoring edges is at the angle $\gamma$ with respect to an axis parallel to the longitudinal axis. The scoring edges are fundamentally different from common screw or bolt threads which work on the principle of pitch angles meshing together and pushing against each other. A screw or bolt has an intentional flat on the major outside diameter of its threads providing clearance from the major inside diameter of mating threads, such as on a nut. If the pitch angles came to sharp points or had knife edges as in the present invention, the nut-and-screw (or bolt) combination would not function.

Figure 4:
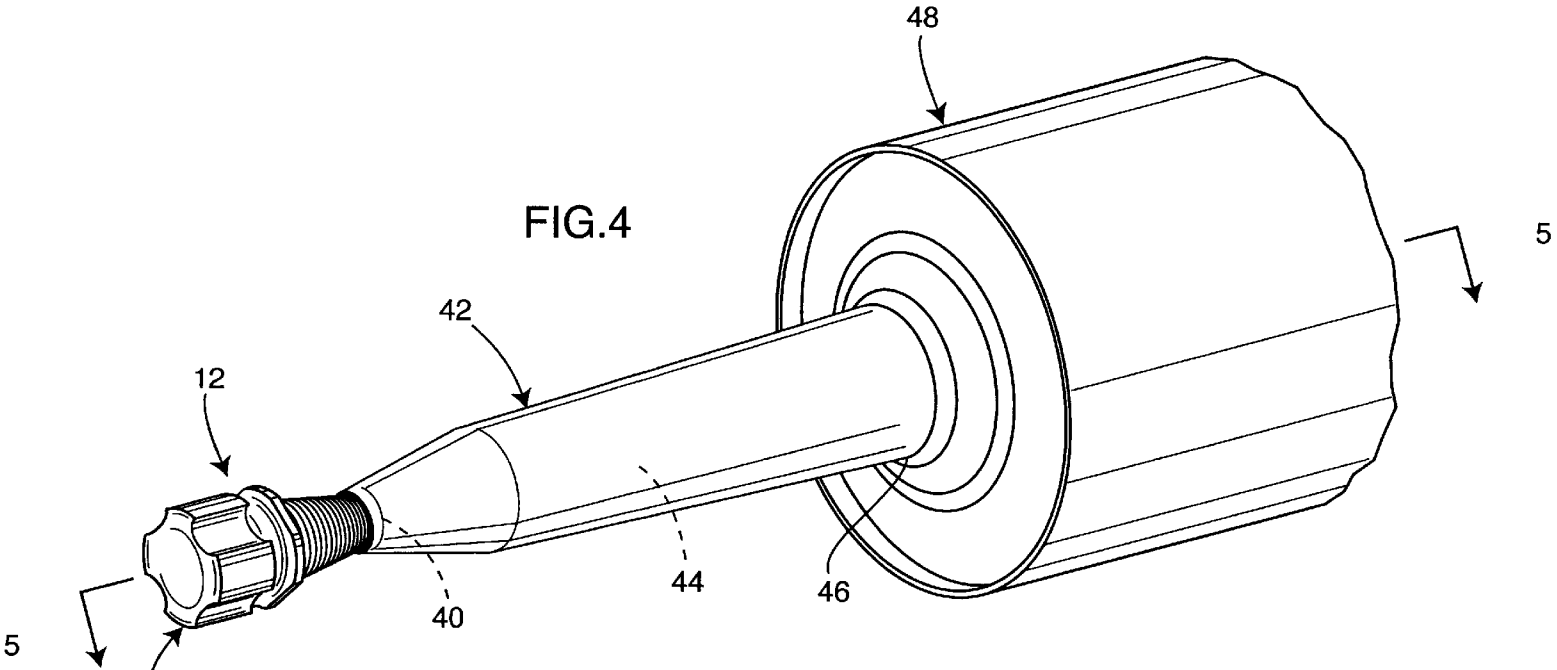
FIG. 4 is a perspective view of the FIG. 1A plug inserted into the distally tapering nozzle of a caulking tube.
Figure 5:
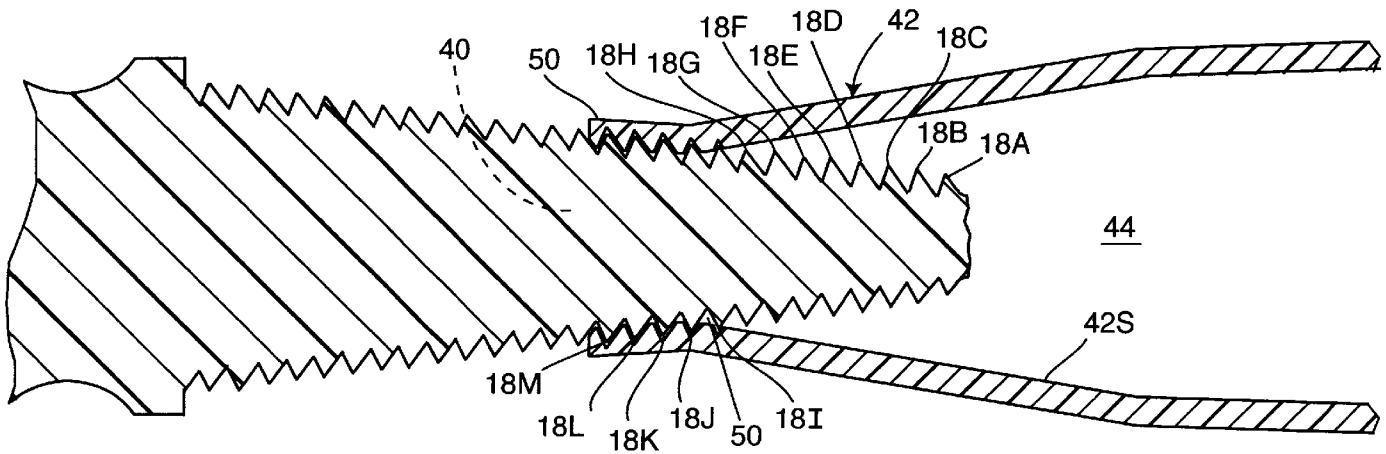
FIG. 5 is a sectional view taken along line 5—5 in FIG. 4 showing grooves scored into the nozzle inner surface by the scoring edges.

Referring to FIGS. 4 and 5, plug 12 is rotationally inserted within dispensing aperture 40 of a distally tapering nozzle 42 made of a soft plastic and having an axially symmetric bore 44 therethrough determined by a distally tapering interior surface 42S. Nozzle 42 is attached proximally to an end 46 of a caulking tube 48. The screwdriver handle-like conformation of upper portion 14 enables a user to tightly grip the plug and firmly insert it through aperture 40, which initially may be smaller in circumference than the leading (smallest circumference) scoring edge, thus deforming, viz., expanding, the annular segment of surface 42S contacted as the leading or leading and second scoring edges penetrate. The plug is then further screwed in at least one-half to one full revolution in a clockwise direction, penetrating further into the nozzle and creating grooves in the surface segment as the points of additional scoring edges contact the segment. The points score rather than carve the interior surface since no plastic material is excised. The scoring edges have a barb-like shape which presents little resistance going into the nozzle but is highly resistant to accidentally being pulled directly out, rather than being screwed out (counterclockwise) to remove the plug. When the plug is reinserted and screwed in (clockwise) the points track within the pre-existing grooves. In FIG. 5, aperture 40 is sufficiently wide that the first eight scoring edges 18A, 18B, 18C, 18D, 18E, 18F, 18G, 18H have freely entered bore 44 before the ninth edge 18I begins scoring the interior surface, followed by edges 18J, 18K, 18L, 18M. It has been found empirically that as few as two edges provide a grip which easily supports the weight of a full tube when held vertically by the inserted plug. As shown in FIG. 5, because the points only partially score the nozzle interior surface, there is a small gap 50 between each point and scored groove. However, an air-tight seal is formed because residual caulking or adhesive material in the nozzle is trapped within the gaps. Preferably, plug assembly 10 is fabricated from a glass-filled thermoplastic containing about 15 to about 30 percent glass fiber material. The low viscosity characteristics of a thermoplastic such as NYLON™ during molding permits filling very fine scoring edge details in the mold and particularly allows filling the sharp point at which edge surfaces 18L, 18T meet. The glass fiber additive maintains the sharpness of the points and provides the hardness and strength required to score surface 42S. Although FIGS. 4 and 5 show aperture 40 to be square-cut, i.e., generally orthogonal to axially symmetric bore 44, plug 12 works equally well when the aperture is bias-cut, i.e., at an angle to the bore. The leading or leading scoring edges can still engage surface 42S, scoring grooves which are enhanced by clockwise screwing in of the plug.

What is claimed is:

1. A plug assembly for removably resealing an aperture of a preselected circumference in a dispensing nozzle attached to a container of an extrudable material, the nozzle made of a deformable soft plastic and having an axially symmetric bore therethrough determined by a distally tapering interior surface, the plug assembly comprising a plug comprising:

an upper portion rigidly attached to a conically tapering lower portion, the lower portion having a multiplicity of successively contiguous circumferential scoring edges terminating in a leading scoring edge determining a distal end having a preselected circumference, each distally successive scoring edge slightly smaller in circumference, each scoring edge canted rearwardly at a preselected first acute angle to a common longitudinal axis, each scoring edge having a leading edge surface making a preselected second acute angle with respect to an axis orthogonal to the longitudinal axis and a trailing edge surface making a preselected third acute angle with respect to said orthogonal axis, the leading and trailing edge surfaces forming a sharp point; and the circumference of the distal end of the plug lower portion sized to enable penetration of the aperture by at least the leading scoring edge, thereby contacting and scoring at least one groove in an annular segment of the nozzle interior surface.

2. The plug assembly of claim 1, further comprising a rigid, generally cylindrical piercing shaft having a first end rigidly attached to the plug distal end, and an opposed second end terminating in a blunt tip, the first end proximate to a groove circumscribing the shaft, the plug and shaft breakably separable at the groove.

3. The plug assembly of claim 1, wherein:

said first acute angle is in a range from about 5 degrees to about 12 degrees;

said second acute angle is in a range from about 30 degrees to about 40 degrees; and said third acute angle is in a range from about 15 degrees to about 25 degrees.

4. The plug assembly of claim 2, wherein the plug and shaft are fabricated from a glass-filled thermoplastic containing about 15 to about 30 percent glass fiber material.

5. A plug assembly for removably resealing an aperture of a preselected circumference in a dispensing nozzle attached to a container of an extrudable material, the nozzle made of a deformable soft plastic and having an axially symmetric bore therethrough determined by a distally tapering interior surface, the plug assembly comprising a plug comprising:

an upper portion having a generally planar top surface generally orthogonal to a plurality of convexly arcuate knurls, each pair of neighboring knurls separated by a concavely arcuate depression;

a circumferential skirt having a polygonal plurality of generally planar edge segments, the skirt rigidly attached to the plug upper portion;

a conically tapering lower portion, rigidly attached to the skirt, having a multiplicity of successively contiguous circumferential scoring edges terminating in a leading scoring edge determining a distal end having a preselected circumference, each distally successive scoring edge slightly smaller in circumference, each scoring edge canted rearwardly at a preselected first acute angle to a common longitudinal axis, each scoring edge having a leading edge surface making a preselected second acute angle with respect to an axis orthogonal to the longitudinal axis and a trailing edge surface making a preselected third acute angle with respect to said orthogonal axis, the leading and trailing edge surfaces forming a sharp point; and the circumference of the distal end of the plug lower portion sized to enable penetration of the aperture by at least the leading scoring edge, thereby contacting and scoring at least one groove in an annular segment of the nozzle interior surface.

6. The plug assembly of claim 5, wherein:

said first acute angle is in a range from about 5 degrees to about 12 degrees;

said second acute angle is in a range from about 30 degrees to about 40 degrees; and said third acute angle is in a range from about 15 degrees to about 25 degrees.

7. The plug assembly of claim 5, wherein the plug is fabricated from a glass-filled thermoplastic containing about 15 to about 30 percent glass fiber material.

8. A method for removably resealing an aperture of a preselected circumference in a dispensing nozzle attached to a container of an extrudable material, the nozzle made of a deformable soft plastic and tapering distally and having an axially symmetric bore therethrough determined by a distally tapering interior surface, comprising the steps of:

gripping a handle-like upper portion of a plug, the upper portion rigidly attached to a conically tapering lower portion, the lower portion having a multiplicity of successively contiguous circumferential scoring edges terminating in a leading scoring edge determining a distal end having a preselected circumference, each distally successive scoring edge slightly smaller in circumference, each scoring edge canted rearwardly at a preselected first acute angle to a common longitudinal axis, each scoring edge having a leading edge surface making a preselected second acute angle with respect to an axis orthogonal to the longitudinal axis and a trailing edge surface making a preselected third acute angle with respect to said orthogonal axis, the leading and trailing edge surfaces forming a sharp point, the circumference of the distal end of the plug lower portion sized to enable penetration of the aperture by at least the leading scoring edge;

penetrating the aperture with at least the leading scoring edge, thereby contacting and scoring at least one groove in an annular segment of the nozzle interior surface; and screwing in the plug so as to penetrate further into the nozzle bore, thereby scoring additional grooves in the surface segment as additional scoring edge points contact the surface segment.

9. The method of claim 8, wherein:

said first acute angle is in a range from about 5 degrees to about 12 degrees;

said second acute angle is in a range from about 30 degrees to about 40 degrees; and said third acute angle is in a range from about 15 degrees to about 25 degrees.

10. The method of claim 8, wherein the plug is fabricated from a glass-filled thermoplastic containing about 15 to about 30 percent glass fiber material.

* * * * *